US009377228B2

(12) United States Patent
Lee et al.

(10) Patent No.: US 9,377,228 B2
(45) Date of Patent: Jun. 28, 2016

(54) RECEIVER DRIER FOR VEHICLE AIR CONDITIONER WITH IMPROVED FILTER

(75) Inventors: Ill Jae Lee, Pyeongtaek-si (KR); Myung Soo Jang, Seoul (KR)

(73) Assignee: DOOWON CLIMATE CONTROL CO., LTD, Asan-si, Chungcheongnam-do (KR)

( * ) Notice: Subject to any disclaimer, the term of this patent is extended or adjusted under 35 U.S.C. 154(b) by 731 days.

(21) Appl. No.: 13/819,894

(22) PCT Filed: Jul. 7, 2011

(86) PCT No.: PCT/KR2011/004968
§ 371 (c)(1),
(2), (4) Date: Feb. 28, 2013

(87) PCT Pub. No.: WO2012/030063
PCT Pub. Date: Mar. 8, 2012

(65) Prior Publication Data

US 2013/0152625 A1 Jun. 20, 2013

(30) Foreign Application Priority Data

Sep. 1, 2010 (KR) ..... 10-2010-0085532
Sep. 2, 2010 (KR) ..... 10-2010-0086035

(51) Int. Cl.
*F25B 43/00* (2006.01)
*F25B 39/04* (2006.01)

(52) U.S. Cl.
CPC ..... *F25B 43/00* (2013.01); *F25B 43/003* (2013.01); *F25B 39/04* (2013.01); *F25B 2339/044* (2013.01); *F25B 2339/0441* (2013.01); *F25B 2400/161* (2013.01); *F25B 2400/162* (2013.01)

(58) Field of Classification Search
CPC ..... F25B 2339/044; F25B 2339/0441; F25B 43/00; F25B 43/003; F25B 2400/162; F25B 39/04; F25B 2400/16; F25B 2400/161
USPC ..... 62/474, 509
See application file for complete search history.

(56) References Cited

U.S. PATENT DOCUMENTS 6,260,379 B1 * 7/2001 Manwill ..... B60H 1/3227 62/474
7,461,519 B2 * 12/2008 Fralick ..... F25B 43/006 62/474

(Continued)

FOREIGN PATENT DOCUMENTS

BE 1016886 A3 * 9/2007 ..... F28D 7/0041
DE 19712714 10/1998

(Continued)

OTHER PUBLICATIONS

International Search Report for PCT/KR2011/004968 mailed Jan. 19, 2012 from Korean Intellectual Property Office.

*Primary Examiner* — Frantz Jules
*Assistant Examiner* — Steve Tanenbaum
(74) *Attorney, Agent, or Firm* — Paratus Law Group, PLLC

(57) ABSTRACT

The present invention provides a receiver drier for a vehicle air conditioner including: a tubular body into which a desiccant bag is inserted, and on the outer side of which a refrigerant inlet, through which a refrigerant is introduced from a condenser, and a refrigerant outlet, through which a liquid refrigerant flows out into a sub-cooling zone, are formed, the body having an opening at the lower portion thereof; a filter installed in the body; and a cap having a cap body inserted in and coupled to the opening of the body, wherein a lower part of the filter is inserted into the upper peripheral surface of the cap body, and a guide member protrudes from the top surface of the cap body toward the inner side of the filter and guides the refrigerant supplied through the refrigerant inlet to smoothly flow out through the refrigerant outlet.

18 Claims, 8 Drawing Sheets

(56) References Cited

U.S. PATENT DOCUMENTS

| | | | | |
|---|---|---|---|---|
| 2008/0314252 | A1 | 12/2008 | Min et al. | |
| 2009/0090244 | A1 * | 4/2009 | LeConey | F25B 43/003 96/136 |

FOREIGN PATENT DOCUMENTS

| | | | |
|---|---|---|---|
| DE | 10213178 | | 10/2003 |
| JP | 2000-074528 | | 3/2000 |
| JP | 2000- 07861 | | 4/2000 |
| JP | 2002-228305 | | 8/2002 |
| JP | 2003-042601 | | 2/2003 |
| KR | 20030030501 | A * | 4/2003 |
| KR | 10-2006-0021126 | | 3/2006 |
| KR | 10-0649591 | B1 | 11/2006 |
| KR | 20-0430632 | | 11/2006 |
| KR | 20-0430632 | Y1 | 11/2006 |
| KR | 20-2008-0006038 | | 12/2008 |
| KR | 20-2008-0006038 | U | 12/2008 |

* cited by examiner

RECEIVER DRIER FOR VEHICLE AIR CONDITIONER WITH IMPROVED FILTER

CROSS REFERENCE TO PRIOR APPLICATION

This application is a National Stage Patent Application of PCT International Patent Application No. PCT/KR2011/004968 (filed on Jul. 7, 2011) under 35 U.S.C. §371, which claims priority to Korean Patent Application Nos. 10-2010-0085532 (filed on Sep. 1, 2010) and 10-2010-0086035 (filed on Sep. 2, 2010), which are all hereby incorporated by reference in their entirety.

TECHNICAL FIELD

The present invention relates to a receiver drier for a vehicle air conditioner, and more particularly, to a receiver drier for a vehicle air conditioner that may improve the performance of separating a liquid refrigerant and a gas refrigerant from an introduced refrigerant.

BACKGROUND ART

In general, a receiver drier is installed between a condenser and an expansion valve, temporarily stores a refrigerant introduced from the condenser so as to supply the amount of a liquid refrigerant required according to a load of a cold room to an evaporator and simultaneously separates a gas refrigerant that is not condensed by the condenser and the liquid refrigerant from the refrigerant introduced from the condenser and removes moisture and dissimilar substances contained in the liquid refrigerant so as to supply a complete liquid refrigerant to the expansion valve.

However, in receiver driers according to the related art, the performance of separating the liquid refrigerant and the gas refrigerant from the refrigerant introduced from the condenser is not good. Thus, the performance of the condenser that receives the stored refrigerant from the receiver drier may also be lowered.

DETAILED DESCRIPTION OF THE INVENTION

Technical Problem

The present invention provides a receiver drier for a vehicle air conditioner that may easily separate a liquid refrigerant and a gas refrigerant from a refrigerant introduced from a condenser and may improve the performance of separating the liquid refrigerant and the gas refrigerant from each other so that the performance of the condenser and the performance of the receiver drier can be improved.

Technical Solution

According to an aspect of the present invention, there is provided a receiver drier for a vehicle air conditioner, the receiver drier including: a tubular body into which a desiccant bag is inserted, and on an outer side of which a refrigerant inlet, through which a refrigerant is introduced from a condenser, and a refrigerant outlet, through which a liquid refrigerant flows out into a sub-cooling zone, are formed, the body having an opening at a lower portion thereof; a filter installed in the body; and a cap having a cap body inserted in and coupled to the opening of the body, wherein a lower part of the filter is inserted into an upper peripheral surface of the cap body, and a guide member protrudes from a top surface of the cap body toward an inner side of the filter and guides the refrigerant supplied through the refrigerant inlet to smoothly flow out through the refrigerant outlet.

Effect of the Invention

Thus, in a receiver drier for a vehicle air conditioner according to the present invention, a liquid refrigerant and a gas refrigerant can be easily separated from a refrigerant introduced from a condenser through a coupling portion and a baffle, and a circulating movement of the introduced liquid refrigerant is guided to enable the liquid refrigerant to smoothly flow out through a refrigerant outlet so that the performance of separating the liquid refrigerant and the gas refrigerant from each other can be improved, the introduced refrigerant can flow smoothly and thus performances and durability of the condenser and the receiver drier can be improved.

In addition, according to the present invention, a desiccant bag can be easily taken out of the receiver drier through a connection member so that the desiccant bag can be easily exchanged.

BEST MODE OF THE INVENTION

The present invention will now be described more fully with reference to the accompanying drawings, in which exemplary embodiments of the invention are shown.

Figure 1:
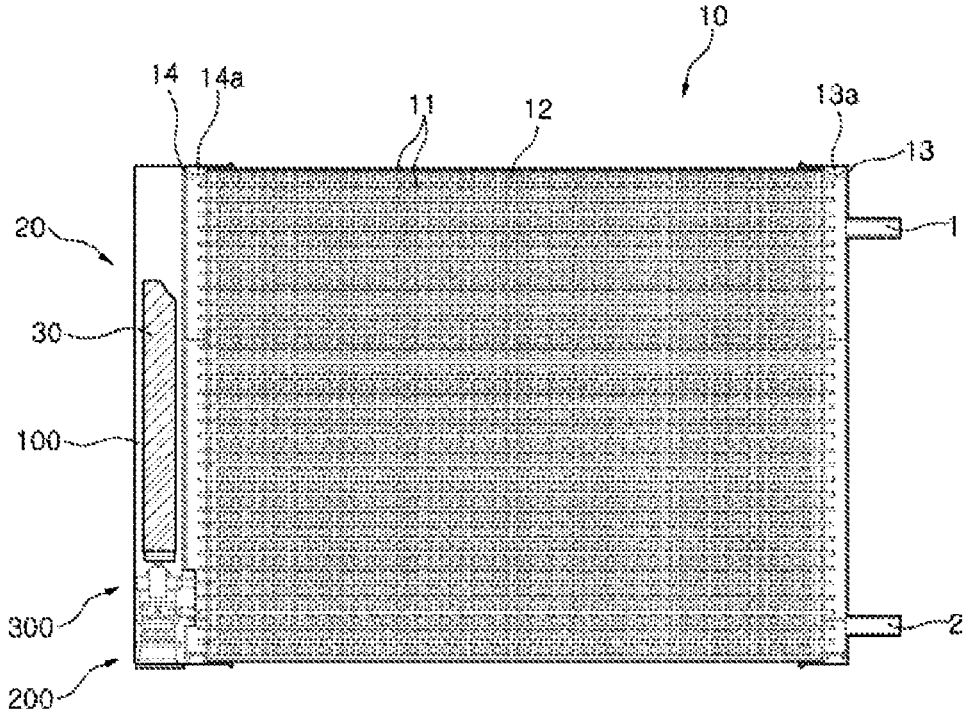
FIG. 1 is a cross-sectional view of a receiver drier-integrated type condenser according to an embodiment of the present invention.

First, referring to FIG. 1, a receiver drier 20 for a vehicle air conditioner according to an embodiment of the present invention is integrated with a condenser 10, stores a refrigerant and removes moisture and dissimilar substances contained in the refrigerant. The receiver drier 20 according to the current embodiment of the present invention is integrated with the condenser 10; however, aspects of the present invention are not limited thereto, and a type of the receiver drier 20 that can be used for the vehicle air conditioner may be used.

First, the condenser 10 includes a first header pipe 13 and a second header pipe 14 that are disposed in parallel to each other and are spaced apart from each other by a predetermined gap, a plurality of tubes 11, of which both ends are inserted into the first header pipe 13 and the second header pipe 14 and which are disposed in parallel to each other, and a plurality of heat-dissipating fins 12 that are interposed between the plurality of tubes 11. Here, an inlet 1 through which a refrigerant is introduced from the condenser 10, and an outlet 2 through which a refrigerant flows out, are formed at upper and lower portions of the second header pipe 14, and the first header pipe 13 interacts with the receiver drier 20. Also, tops and bottoms of the first header pipe 13 and the second header pipe 14 are sealed by cap members 13*a* and 14*a*.

Figure 2:
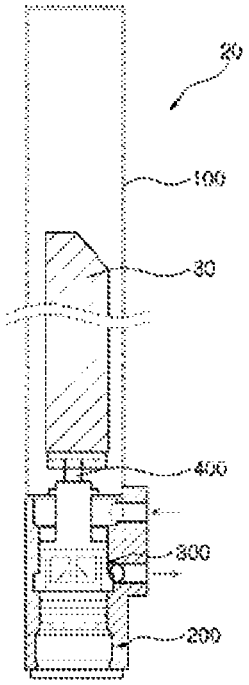
FIG. 2 is a cross-sectional view of a receiver drier illustrated in FIG. 1.

Thus, the receiver drier 20 according to the present embodiment will be described with reference to FIGS. 2 through 4. Referring to FIG. 2, the receiver drier 20 for the vehicle air conditioner according to the present embodiment includes a body 100, a cap 200, a filter 300, a connection member 400, and a desiccant bag 30.

The body 100 is a tubular body, and the desiccant bag 30 is inserted into the tubular body 100, and on the outer side of the tubular body 100, a refrigerant inlet 110 which interacts with a condensation region of the first header pipe 13 of the condenser 10 and through which a refrigerant is introduced from the condenser 10, and a refrigerant outlet 120 which is disposed below the refrigerant inlet 110, which interacts with a sub-cooling zone of the condenser 10 and through which a liquid refrigerant flows out into the sub-cooling zone, are formed. Also, the lower portion of the body 100 is open to the outside, and the body 100 has an opening at the lower portion of the body 100, and the upper portion of the body 100 has a sealed structure. Here, the upper portion of the body 100 may have a sealed or open structure and may also have a sealed structure formed by inserting an additional sealing member into the body 100 to closely contact the body 100.

Figure 3:
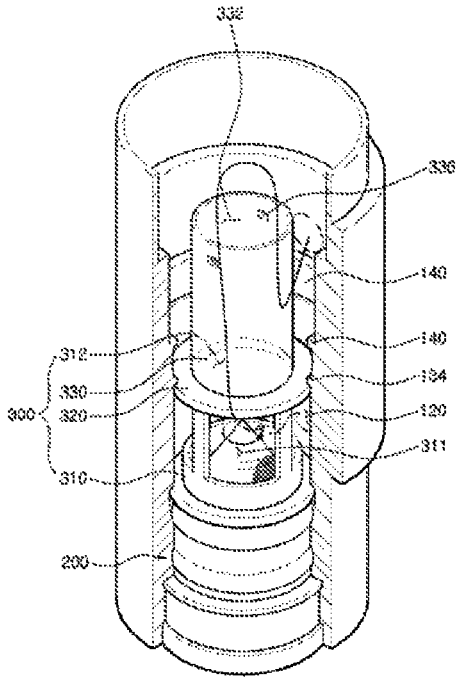
FIGS. 3 and 4 are a partial cross-sectional perspective view of a filter and a cap illustrated in FIG. 2 and the flow of a refrigerant and a cross-sectional view of FIG. 3.
Figure 4:
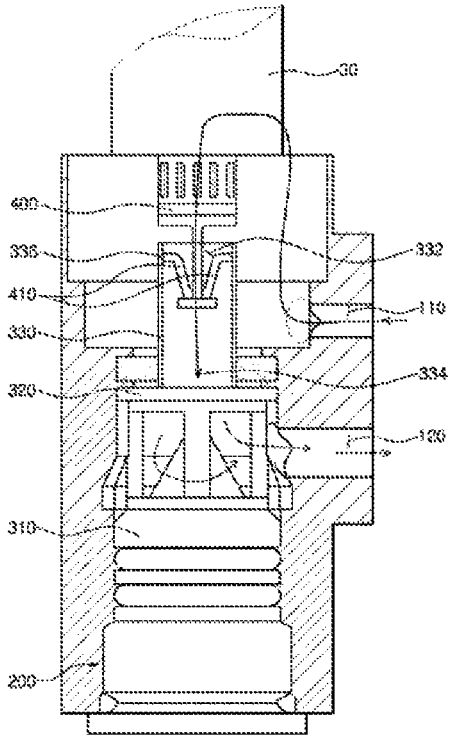

Referring to FIGS. 3 and 4, the body 100 is disposed between a baffle 320 that will be described below and the refrigerant inlet 110. The body 100 includes a protrusion guide (see 132 of FIG. 8) that defines a storage place (or damping space) 140 in which the introduced refrigerant is collected and may be stabilized. The protrusion guide 132 protrudes from the peripheral surface of a coupling portion 330 to be adjacent to the peripheral surface of the coupling portion 330 so that a gas refrigerant of the refrigerant introduced through the refrigerant inlet 110 does not flow into the storage place (or damping space) 140.

Also, a stopper 134 protrudes from the body 100 and enables the upper peripheral surface of the baffle 320 to be caught in the inner circumferential surface of the body 100 so as to limit the filter 300 to be inserted into the inner side of the body 100.

The desiccant bag 30 is inserted into the body 100, i.e., is embedded in the body 100 formed of a material, such as a nonwoven fabric and is coupled to the connection member 400 by fusion; however, aspects of the present invention are not limited thereto. The flow of the refrigerant of the receiver drier 20 having the above structure according to the present embodiment will be described below together with the description of the flow of a refrigerant of the coupling portion 330 of FIG. 8 according to another embodiment of the present invention.

Figure 5:
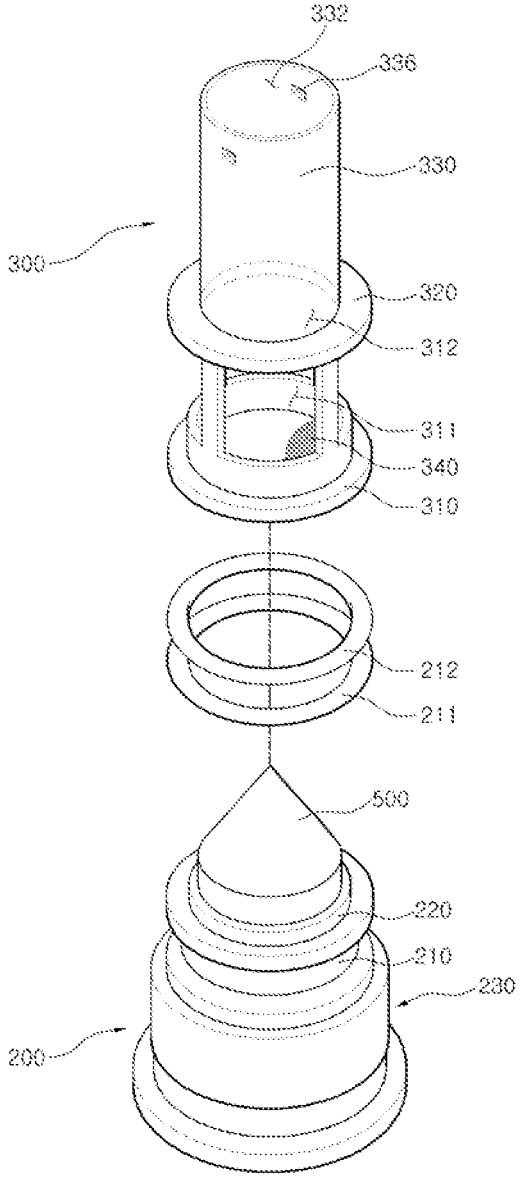
FIG. 5 is an exploded perspective view of the filter and the cap of FIG. 3.
Figure 6:
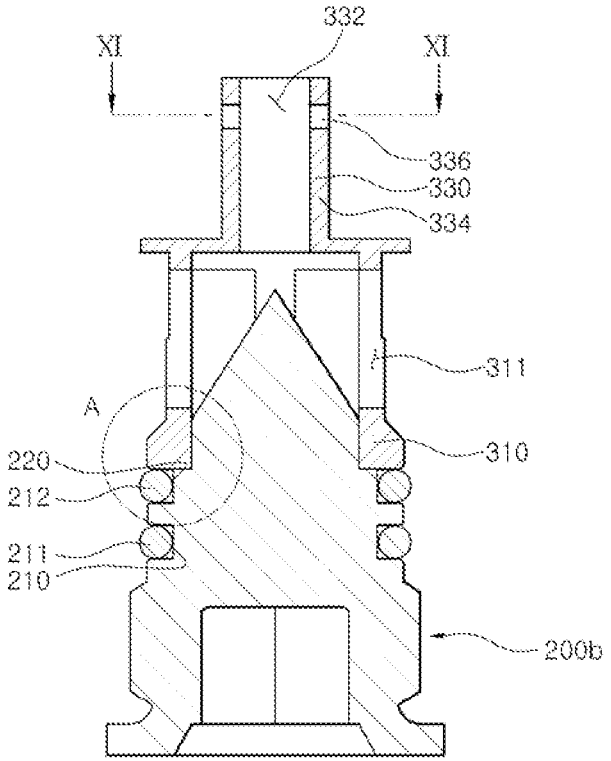
FIG. 6 is a cross-sectional view of the filter and the cap of FIG. 3.

Referring to FIGS. 5 and 6, the cap 200 has a cylindrical cap body 230, is inserted in the opening of the body 100 and allows the body 100 to be sealed. The cap 200 includes the cap body 230 inserted in the opening of the body 100, and a guide member 500 that protrudes from the top surface of the cap body 230 toward the inner side of the filter 300 and is integrated with the cap body 230.

At least one o-ring is inserted into the peripheral surface of the cap body 230 so as to maintain airtightness with the body 100. To this end, at least one o-ring mounting portion corresponding to the number of o-rings is disposed. However, here, two o-rings and two o-ring mounting portions corresponding to two o-rings are disposed.

The cap 200 further includes one or a plurality of o-ring mounting portions 210 and 220, which are integrally formed by surrounding the peripheral surface of the cap body 230, are spaced apart from each other by a predetermined gap in a vertical direction and on which a plurality of o-rings 211 and 212 are mounted (see FIG. 5). The plurality of o-ring mounting portions 210 and 220 include a first o-ring mounting portion 210 into which a first o-ring 211 is inserted, and a second o-ring mounting portion 220, which is disposed above the first o-ring mounting portion 210 and is spaced apart from the first o-ring mount portion 210 by a predetermined gap and into which a second o-ring 212 is inserted.

The first and second o-ring mounting portions 210 and 220 are formed so that compressive forces of the first and second o-rings 211 and 212 that are respectively inserted into the first and second o-ring mounting portions 210 and 220, are different from each other. This is because, when the first and second o-rings 211 and 212 are compressed over a permanent deformation limit and are inserted into the first and second o-ring mounting portions 210 and 220, good airtightness is achieved at an early stage, but as time elapses, leakage may occur and contrary to this, when the first and second o-rings 211 and 212 are inserted into the first and second o-ring mounting portions 210 and 220 with small amounts of compression, leakage may occur at an early stage and thus in consideration of these matters and in combination thereof, one of the first and second o-rings 211 and 212 has a small compression amount and the other one thereof has a large compression amount so that leakage of the first and second o-rings 211 and 212 can be effectively prevented for a long time. Also, when the first and second o-rings 211 and 212 have the same structures, i.e., have the same compressive forces, in a state where each of the first and second o-rings 211 and 212 is inserted into each of the first and second o-ring mounting portions 210 and 220, the first and second o-rings 211 and 212 may have different compressive forces so that circumferential lengths t of the first o-ring mounting portion 210 and the second o-ring mounting portion 220 may be different from each other.

A structure of coupling the cap 200 and the opening of the body 100 may be various types of coupling structures, such as a structure in which the peripheral surface of the cap 200 is compressively inserted into the opening of the body 100, a structure in which the cap 200 is coupled to the opening of the body 100 through a protrusion and an insertion groove to be attached/detached to/from the opening of the body 100 in a snap manner, and a structure in which the cap 200 is firmly screw-coupled to the opening of the body 100 by forming a screw portion.

The bottom of the cap body 230 is flat. However, various embodiments including the case that the bottom of the cap body 230 may include a rib subtraction portion (not shown) so as to reduce the use of material, may be possible as occasion demands.

The guide member 500 enables the flow of the refrigerant in the filter 300 to be stabilized and the refrigerant to smoothly flow out through the refrigerant outlet 120. That is, the guide member 500 guides the refrigerant that is introduced through the refrigerant inlet 110 and is supplied through a through hole 312 to smoothly flow out through the refrigerant outlet 120, guides a circulating movement of the refrigerant to stabilize the flow of the refrigerant, reduces a space inside a filter body 310 to reduce time when the refrigerant reaches the refrigerant outlet 120 and to enable the introduced refrigerant to quickly flow out through the refrigerant outlet 120. The guide member 500 has the shape of a cone that becomes sharp as it gets close the upper portion of the cone. However, this is just an embodiment, and all types of the guide member 500 that can achieve the above purpose having a longitudinal cross-sectional shape, such as an oval, other than a triangle, may be used. The upper part of the guide member 500 is lower than the through hole 312, for example, about 3 mm lower than the through hole 312.

The filter 300 is inserted into the upper portion of the cap 200 and includes the filter body 310, the baffle 320, and the coupling portion 330.

The filter body 310 has a cylindrical shape with a hollow inside, and the lower portion of the filter body 310 is open, and the lower part of the filter body 310 is inserted into the upper peripheral surface of the cap body 230, and on the outer side of the filter body 310, a plurality of discharge holes 311 through which the refrigerant supplied through the through hole 312 is discharged, and a filter net 340 that filters the refrigerant discharged through the plurality of discharge holes 311, are formed.

The baffle 320 is integrated with the upper portion of the filter body 310 and has the through hole 312 formed in the middle of the baffle 320. The baffle 320 is disposed between the refrigerant inlet 110 and the refrigerant outlet 120, and the peripheral surface of the baffle 320 faces and contacts the inner circumferential surface of the body 100 and prevents the gas refrigerant of the refrigerant introduced through the refrigerant inlet 110 from flowing in a downward direction. Thus, the baffle 320 may provide time when the liquid refrigerant is stabilized in the storage place (or damping space) 140. Also, the baffle 320 supports the upper peripheral surface of the filter 300 not to shake in the body 100.

The coupling portion 330 has a tubular shape, and the lower portion of the coupling portion 330 extends and protrudes in a direction of the desiccant bag 30 along the through hole 312 of the baffle 320 and serves as a passage on which the refrigerant is introduced through a first inlet hole 332 formed in the upper portion of the coupling portion 330 and flows out through the through hole 312. The coupling portion 330 determines a flow direction of the refrigerant supplied through the first inlet hole 332. In the present embodiment, the coupling portion 330 is stood in a vertical direction in which the refrigerant introduced through the first inlet hole 332 flows more smoothly.

Figure 7:
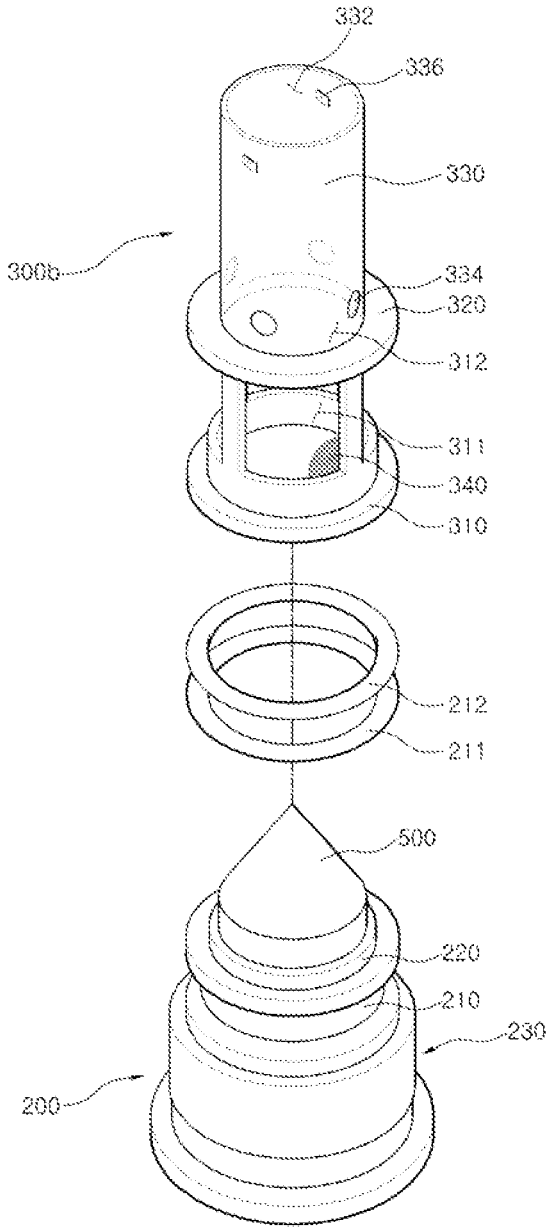
FIG. 7 is an exploded perspective view of a filter of FIG. 3, according to another embodiment of the present invention.

FIG. 7 is an exploded perspective view of a filter 300*b* of FIG. 3, according to another embodiment of the present invention. Referring to FIG. 7, on the lower peripheral surface of the filter 300*b*, a plurality of second inlet holes 334 are formed through the coupling portion 330, together with the first inlet hole 332. The plurality of second inlet holes 334 enables the liquid refrigerant that flows in the downward direction of the refrigerant introduced through the refrigerant inlet 110 to be introduced through the plurality of second inlet holes 334 and to flow out through the through hole 312.

Figure 8:
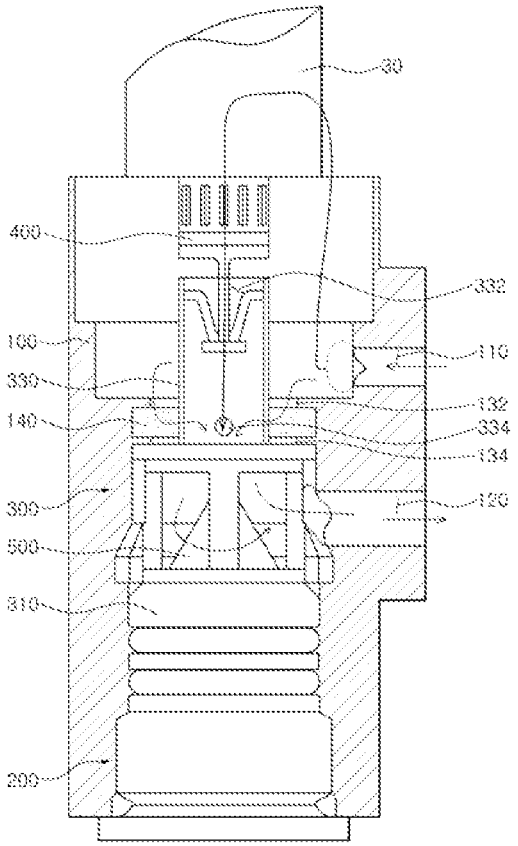
FIG. 8 is a cross-sectional view of the flow of a refrigerant according to the filter illustrated in FIG. 7.

The flow of the refrigerant according to the present embodiment by using the above-described structure will be described with reference to FIG. 8. Referring to FIG. 8, the refrigerant is introduced through the refrigerant inlet 110, and part of the refrigerant passes through the desiccant bag 30 so that a liquid refrigerant is introduced into the first inlet hole 332 and flows out through the through hole 312, and the liquid refrigerant of the introduced refrigerant is introduced into the storage place (damping space) 140 and then is introduced into the second inlet holes 334 and flows out through the through hole 312. Then, the refrigerant that flows out through the through hole 312, flows out though the refrigerant outlet 120 via the filter net 340 of the filter body 310. That is, the first inlet hole 332 is formed in the upper portion of the coupling portion 330, and the liquid refrigerant of the refrigerant introduced through the refrigerant inlet 110 that is moved in an upward direction and then passes through the desiccant bag 30, is introduced through the first inlet hole 332, and the liquid refrigerant of the refrigerant introduced through the refrigerant inlet 110 that is not moved in the upward direction but is immersed in the downward direction, is introduced through the second inlet holes 334 that are relatively lower than the first inlet hole 332. Thus, in the receiver drier for the vehicle air conditioner 20 according to the present embodiment, the liquid refrigerant is introduced by the filter 300*b* in which the first inlet hole 332 and the second inlet holes 334 are formed. Thus, the liquid refrigerant and the gas refrigerant of the refrigerant introduced from the condenser 10 can be easily separated from each other, and the guide member 500 is disposed, enables the smooth flow of the refrigerant in the filter 300*b* and enables the refrigerant to smoothly flow out through the refrigerant outlet 120 so that the performance of the receiver drier 20 can be improved.

Furthermore, the second inlet holes 334 are formed in positions corresponding to the storage place (or damping space) 140 so as to enable the liquid refrigerant in the storage place (or damping space) 140 to be easily introduced into the second inlet holes 334. In this case, the coupling portion 330 enables the first inlet hole 332 and the through hole 312 to be aligned in the vertical direction and enables the smooth flow of the refrigerant.

A plurality of hanging portions (see 336 of FIG. 11) into which elastic protrusions 410 of the connection member 400 that will be described below are inserted and are caught in, are formed on the inner circumferential surface of the coupling portion 330. The plurality of hanging portions 336 are formed to correspond to the positions and the number of the elastic protrusions 410. Like in the present embodiment, all coupling structures of which positions may be fixed with being coupled to the elastic protrusions 410, such as a structure in which hanging holes are formed in the inner circumferential surface of the coupling portion 330 and the elastic protrusions 410 penetrate and are inserted into the hanging holes, and a structure in which the elastic protrusions 410 are inserted into and are coupled to the hanging portions 336 by forming the hanging portions 336 in the form of grooves, may be used.

Figure 9:
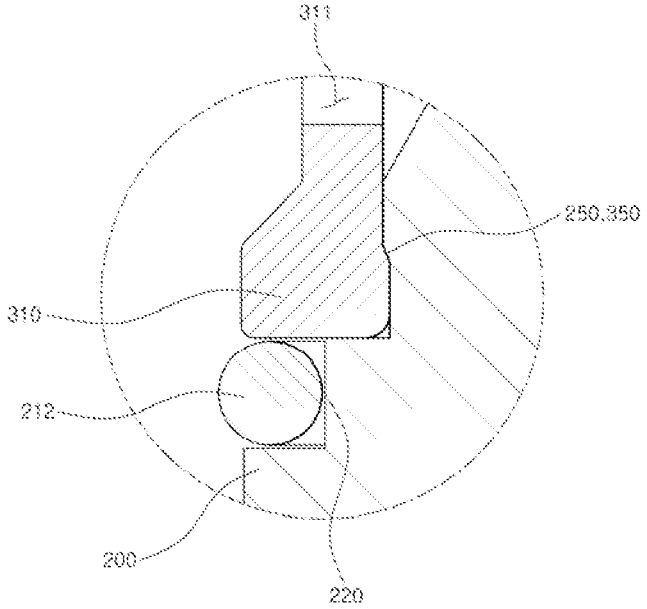
FIG. 9 is an enlarged view of portion 'A' of FIG. 6.

Referring to FIG. 9, an insertion groove 250 is formed in the upper peripheral surface of the cap 200. The filter body 310 includes a protrusion 350 that protrudes from the upper part of the cap 200 along the lower peripheral surface of the cap 200 of the upper part of the cap 200. Thus, the cap 200 and the filter body 310 may improve a bonding force in the axial direction of the cap 200 and the filter 300 (vertical direction) by using the insertion groove 250 and the protrusion 350.

Figure 10:
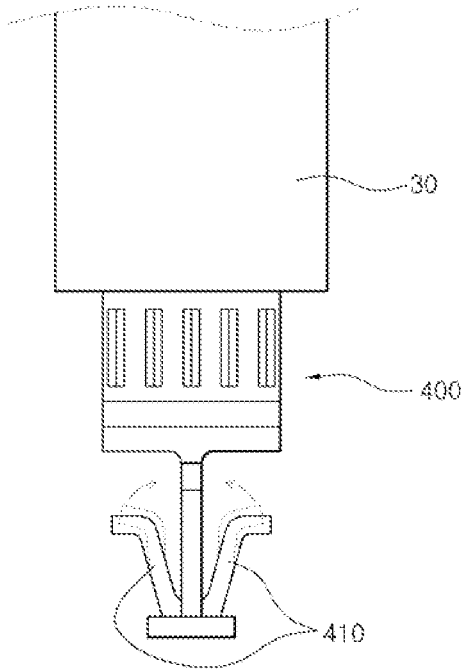
FIG. 10 is a front view of a connection member illustrated in FIG. 4.

Referring to FIG. 10, the connection member 400 is disposed between the desiccant bag 30 and the filter 300, and one end of the connection member 400 is coupled to the lower portion of the desiccant bag 30, and the other end of the connection member 400 is coupled to the coupling portion 330 of the filter 300 to be attached/detached to/from the coupling portion 330. The connection member 400 connects the desiccant bag 30 and the filter 300 to each other and allows the desiccant bag 30 to be taken out of the opening together with the cap 200 and the filter 300 that are separated from each other when the cap 200 is separated from the filter 300. In detail, one end of the connection member 400 is coupled to and fixed to the desiccant bag 30, and the other end thereof is coupled to the coupling portion 330 to be attached/detached to/from the coupling portion 330 through the plurality of elastic protrusions 410 that are coupled to each other while becoming wider in a radial direction. The elastic protrusions 410 are elastically inserted into and are coupled to the hanging protrusions 336 formed on the inner circumferential surface of the coupling portion 330. When the elastic protrusions 410 are inserted into the coupling portion 330, they become narrower and thus they may be easily inserted into the coupling portion 330, and when the elastic protrusions 410 are located at the hanging portions 336, the elastic protrusions 410 become wider and are inserted into and coupled to the hanging protrusions 336.

Figure 11:
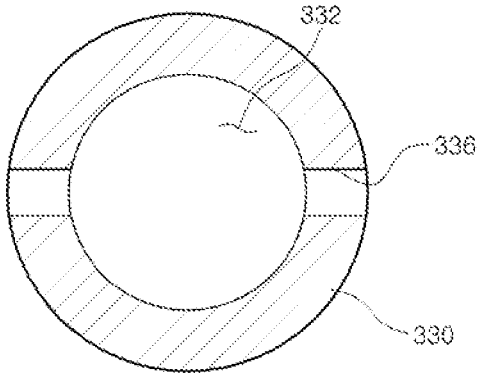
FIG. 11 is a cross-sectional view taken along a line XI-XI of FIG. 6.
Figure 12:
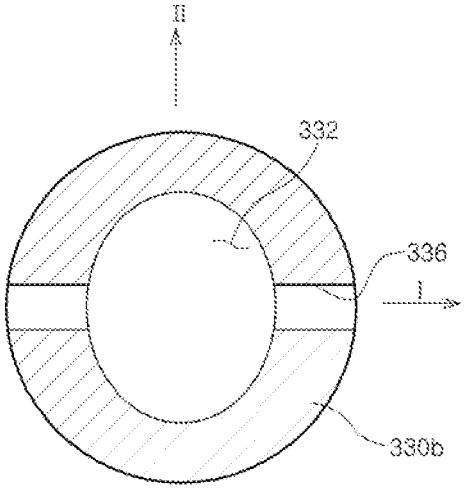
FIG. 12 is a cross-sectional front view of a coupling portion of FIG. 11, according to another embodiment of the present invention.

FIG. 11 illustrates a latitudinal cross-sectional shape of a place of the coupling portion 330 where the hanging portions 336 are located. Referring to FIG. 11, the coupling portion 330 has a circular tubular shape that can be easily manufactured and enables the smooth flow of the refrigerant. On the other hand, referring to FIG. 12, a coupling portion **330*b* has an oval shape of an inner circumferential surface into which and to which the connection member 400 is inserted and is coupled, so that the elastic protrusions 410 can be smoothly inserted in the coupling portion 330*b*. The oval inner circumferential surface shape of the coupling portion 330*b* enables the elastic protrusions 410 of the connection member 400 to elastically become narrower and wider. In the present embodiment, when the connection member 400 is easily inserted into the coupling portion 330*b* in a direction II in which the diameter of the coupling portion 330*b* is large, is turned in a direction I by rotating by 90 degrees and the elastic protrusions 410 are located in the place where the hanging protrusions 336 are located, the elastic protrusions 410 become wider naturally and are inserted into the hanging protrusion 336**.

Figure 13:
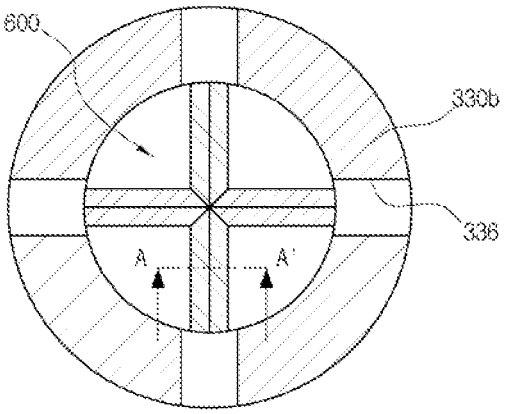
FIG. 13 is a cross-sectional front view of a partition rib disposed on the coupling portion of FIG. 11.
Figure 14:
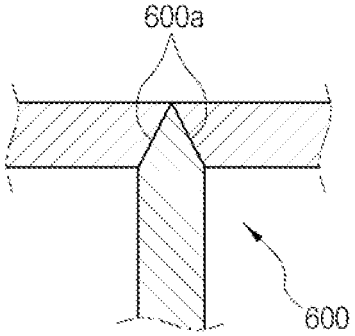
FIG. 14 is a cross-sectional view taken along a line A-A' of FIG. 13.

Referring to FIG. 13, the coupling portion **330*b* has a hollow tubular shape, and on the inner circumferential surface of the coupling portion 330*b*, a partition rib 600 that prevents eddy of the refrigerant introduced through the first inlet hole 332 and enables the introduced refrigerant to flow as a steady flow, is formed. Here, the partition rib 600 may be disposed in a cross shape, as illustrated in FIG. 13. Also, as illustrated in FIG. 14, the cross-section of the partition rib 600 is a triangular shape of which top is sharp, so that the partition rib 600 guides the introduced refrigerant to ride along a hatched surface 600*a* and eddy of the introduced refrigerant can be prevented. However, the arrangement and cross-sectional structure of the partition rib 600** are just examples, and all structures that can prevent eddy of the introduced refrigerant without adversely affecting the flow of the refrigerant, may be used.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

The present invention can be used in a vehicle air conditioner, in particular, in a receiver drier integrated with a condenser.

The invention claimed is:

1. A receiver drier for a vehicle air conditioner, the receiver drier comprising:

a tubular body into which a desiccant bag is inserted, and on an outer side of which a refrigerant inlet, through which a refrigerant is introduced from a condenser, and a refrigerant outlet, through which a liquid refrigerant flows out into a sub-cooling zone, are formed, the tubular body having an opening at a lower portion thereof;

a filter installed in the tubular body; and a cap having a cap body inserted in and coupled to the opening of the tubular body, wherein a lower portion of the filter is coupled to an upper peripheral surface of the cap body, and a guide member protrudes from a top surface of the cap body toward an inner side of the filter and guides the refrigerant supplied through the refrigerant inlet to flow out through the refrigerant outlet, wherein the filter comprises:

a filter body coupled to the cap body and configured to filter the refrigerant;

a baffle provided at an upper portion of the filter body and having a through hole formed in a middle of the baffle; and a coupling portion extending from the baffle toward a top of the tubular body and having a first inlet hole formed at a top thereof, wherein the first inlet hole faces the though hole and directly communicate with the through hole to allow the refrigerant introduced into the coupling portion via the first inlet hole to flow into the filter body via the through hole.

2. The receiver drier of claim 1, wherein the guide member has a shape of a cone.

3. The receiver drier of claim 1, wherein the filter body has a cylindrical shape with a hollow inside, a lower portion of the filter body is open, and an upper portion of the cap is inserted into the lower portion of the filter body, and wherein on an outer side of the filter body, a plurality of discharge holes through which the refrigerant supplied through the through hole is discharged, and a filter net that filters the refrigerant discharged through the plurality of discharge holes, are formed.

4. The receiver drier of claim 1, wherein the baffle is disposed between the refrigerant inlet and the refrigerant outlet and has a peripheral surface that faces and contacts an inner circumferential surface of the tubular body or is adjacent to the inner circumferential surface of the tubular body.

5. The receiver drier of claim 1, wherein, on an outer side of the coupling portion, a plurality of second inlet holes that enable a liquid refrigerant of the refrigerant introduced through the refrigerant inlet to be introduced through the plurality of second inlet holes and to flow out through the through hole, are formed through the coupling portion.

6. The receiver drier of claim 5, wherein the tubular body comprises a protrusion guide that is disposed between the baffle and the refrigerant inlet and defines a storage place in which the refrigerant introduced through the refrigerant inlet is collected and is stabilized and then flows out through the second inlet holes.

7. The receiver drier of claim 6, wherein the second inlet holes are formed in positions corresponding to the storage place.

8. The receiver drier of claim 6, wherein the protrusion guide protrudes from an inner circumferential surface of the tubular body to be adjacent to a peripheral surface of the coupling portion so that a gas refrigerant of the refrigerant introduced through the refrigerant inlet does not flow into the storage place.

9. The receiver drier of claim 1, wherein a stopper protrudes from an inner circumferential surface of the tubular body and enables the the baffle to be caught at the tubular body.

10. The receiver drier of claim 1, wherein the coupling portion has a hollow tubular shape, and on an inner circumferential surface of the coupling portion, a partition rib that partitions the first inlet hole off and prevents eddy of the refrigerant introduced through the first inlet hole, is formed.

11. The receiver drier of claim 1, wherein the coupling portion has a tubular shape and is stood in a vertical direction in which the refrigerant introduced through the first inlet hole flows.

12. The receiver drier of claim 1, wherein the first inlet hole and the through hole are aligned in a vertical direction.

13. The receiver drier of claim 1, wherein the cap further comprises one or a plurality of o-ring mounting portions, which are integrally formed by surrounding the upper peripheral surface of the cap body, are spaced apart from each other by a predetermined gap in a vertical direction, and on which a plurality of o-rings are mounted.

14. The receiver drier of claim 1, further comprising a connection member that is disposed between the desiccant bag and the filter, has one end coupled to the desiccant bag and the other end coupled to the filter, and allows the desiccant bag to be taken out of the opening together with the cap and the filter when the cap is separated from the tubular body.

15. The receiver drier of claim 14, wherein the coupling portion has a circular or oval shape of an inner circumferential surface.

16. The receiver drier of claim 1, wherein the first inlet hole and the through hole are normal to a vertical direction, and wherein the first inlet hole and the through hole are disposed along a vertical direction to be concentric with each other.

17. The receiver drier of claim 1, wherein the first inlet hole and the through hole face the top of the tubular body.

18. The receiver drier of claim 6, wherein the storage place is defined by the protrusion guide, the baffle, and an inner circumferential surface of the tubular body, and a peripheral surface of the coupling portion.

* * * * *